US007069985B2

(12) United States Patent
Wang

(10) Patent No.: US 7,069,985 B2
(45) Date of Patent: Jul. 4, 2006

(54) LEAKAGE RESISTANT SHROUD HANGER

(75) Inventor: Chengbao Wang, Oklahoma City, OK (US)

(73) Assignee: Wood Group ESP, Inc., Oklahoma City, OK (US)

( * ) Notice: Subject to any disclaimer, the term of this patent is extended or adjusted under 35 U.S.C. 154(b) by 246 days.

(21) Appl. No.: 10/613,852

(22) Filed: Jul. 3, 2003

(65) Prior Publication Data

US 2005/0194126 A1 Sep. 8, 2005

Related U.S. Application Data

(60) Provisional application No. 60/478,813, filed on Jun. 17, 2003.

(51) Int. Cl.
*E21B 43/12* (2006.01)

(52) U.S. Cl. ..... 166/68; 166/105

(58) Field of Classification Search ..... 166/68, 166/105, 105.5, 107
See application file for complete search history.

(56) References Cited

U.S. PATENT DOCUMENTS 4,342,538 A * 8/1982 Wolford et al. ..... 415/231
4,386,653 A 6/1983 Drake
5,551,708 A * 9/1996 Vesey et al. ..... 277/390
5,988,284 A 11/1999 Dea
6,082,452 A 7/2000 Shaw et al.
6,167,965 B1 * 1/2001 Bearden et al. ..... 166/250.15
6,202,744 B1 3/2001 Shaw
6,364,013 B1 4/2002 Watson et al.
6,412,563 B1 * 7/2002 William St. Clair et al. .... 166/372
6,568,475 B1 5/2003 Grubb et al.
6,598,681 B1 * 7/2003 Berry ..... 166/369
2003/0141056 A1 * 7/2003 Vandevier ..... 166/265

FOREIGN PATENT DOCUMENTS

EP 0322958 * 7/1989

* cited by examiner

*Primary Examiner*—William Neuder
(74) *Attorney, Agent, or Firm*—Crowe & Dunlevy, P.C.

(57) ABSTRACT

Disclosed is a submersible pumping system for pumping wellbore fluids. The submersible pumping system includes a motor assembly, a pump assembly connected to the motor assembly, and a shroud assembly attached to the pump assembly. The shroud assembly includes a shroud having a connection end and an intake end. The shroud assembly at least partially encloses the motor assembly and includes a sealing ring adjacent the shroud prevents the wellbore fluid from entering the shroud at the connection end. The shroud assembly also preferably includes a retaining ring that holds the sealing ring in place.

5 Claims, 2 Drawing Sheets

LEAKAGE RESISTANT SHROUD HANGER

RELATED APPLICATIONS

This application claims priority to U.S. Provisional Patent Application No. 60/478,813, entitled "Non-Leaking Shroud Hanger for ESP System", filed Jun. 17, 2003, which is herein incorporated by reference.

FIELD OF THE INVENTION

This invention relates generally to the field of submersible pumping systems, and more particularly, but not by way of limitation, to a shroud for use with a submersible pumping system.

BACKGROUND

Submersible pumping systems are often deployed into wells to recover petroleum fluids from subterranean reservoirs. Typically, the submersible pumping system includes a number of components, including one or more fluid filled electric motors coupled to one or more high performance pumps. Other useful components include seal sections and gearboxes. Each of the components in a submersible pumping system must be engineered to withstand the inhospitable downhole environment.

The demanding duty cycle of the motor emphasizes the need for keeping the motor at a relatively cool operating temperature. The internal motor lubricant and motor components last much longer if kept at low operating temperatures. Additionally, lower operating temperatures result in reduced levels of scaling that occur when well fluids encounter the hot motor. Maintenance required to remove the scaling is thereby reduced or eliminated such that an aggressive duty cycle of the motor can be maintained.

Shrouds are often placed around the components of the submersible pumping system to increase the flow of well fluids around the exterior of the motor. Typically, a connection end of the shroud is connected to a portion of the pump assembly. Then, an intake end of the shroud is left open to provide a path by which the well fluids can enter the shroud, pass by the motor, and enter the pump intake. The resulting increase in the velocity and volume of well fluids around the motor helps cool the motor.

Shrouds can be connected to the pump, pump intake, or any pumping assembly component that permits the well fluid to be routed along the motor and into the pump intake. In the past, however, shrouds have been connected to the pumping assembly such that well fluids leak through the connection end of the shroud. When well fluid is permitted to enter the shroud at both the connection end and the intake end, the flow of well fluid around the motor diminishes and the cooling potential of the well fluid decreases.

There is, therefore, a continued need for a shroud for use with a pumping system that prevents leaks from undesired locations, increases the velocity and volume of well fluids around the motor, and maintains lower temperatures for the motor. It is to these and other deficiencies and requirements in the prior art that the present invention is directed.

SUMMARY OF THE INVENTION

Preferred embodiments of the present invention provide a submersible pumping system for pumping wellbore fluids. The submersible pumping system includes a motor assembly, a pump assembly connected to the motor assembly, and a shroud assembly attached to the pump assembly. The shroud assembly includes a shroud having a connection end and an intake end. The shroud assembly at least partially encloses the motor assembly and includes a sealing ring adjacent the shroud prevents the wellbore fluid from entering the shroud at the connection end. The shroud assembly also preferably includes a retaining ring that holds the sealing ring in place.

DETAILED DESCRIPTION OF THE PREFERRED EMBODIMENT

Figure 1:
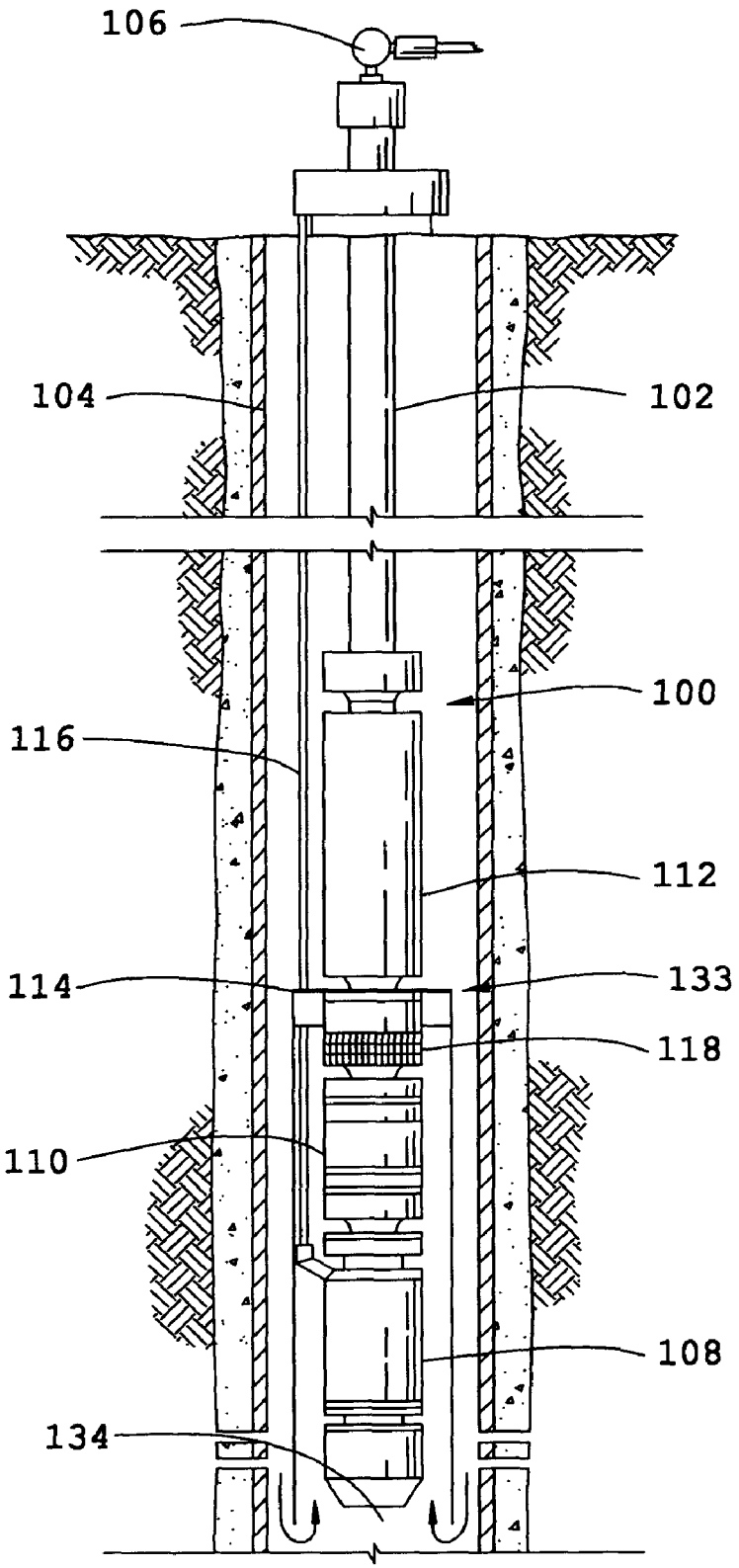
FIG. 1 is an elevational view of a submersible pumping system disposed in a wellbore.

In accordance with a preferred embodiment of the present invention, FIG. 1 shows an elevational view of a pumping system 100 attached to production tubing 102. The pumping system 100 and production tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas. The production tubing 102 connects the pumping system 100 to a wellhead 106 located on the surface.

The pumping system 100 preferably includes a motor assembly 108, a seal section 110, a pump assembly 112 and a shroud assembly 114. The seal section 110 shields the motor assembly 108 from axial thrust loading produced by the pump assembly 112 and from ingress of fluids produced by the well. Also, the seal section 110 affords protection to the motor assembly 108 from expansion and contraction of motor lubricant.

The motor assembly 108 is provided with power from the surface by a power cable 116. The motor assembly 108 converts electrical power into mechanical power to drive the pump assembly 112. Although only one pump assembly 112 and only one motor assembly 108 are shown, it will be understood that more than one of each can be connected to accommodate specific applications. The pump assembly 112 is preferably fitted with a pump intake 118 to allow well fluids from the wellbore 104 to enter the pump assembly 112. The pump intake 118 has holes to allow the well fluid to enter the pump assembly 112, and the well fluid is forced to the surface with the pump assembly 112 through production tubing 102.

Figure 2:
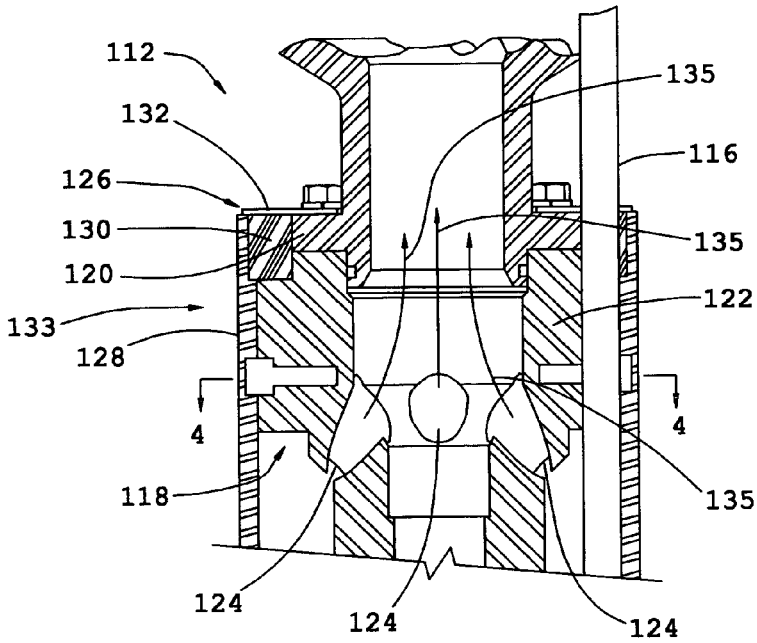
FIG. 2 is a partial cross sectional view of a pump assembly for use with the submersible pumping system of FIG. 1.

Referring now to FIG. 2, shown therein is an elevational partial cross-sectional view of a preferred embodiment of the pump assembly 112. The pump assembly 112 is shown to include the pump intake 118 and a pump connector plate 120, to which the pump intake 118 is preferably attached. The pump intake 118 includes an intake housing 122 and inlets 124, which allow well fluid to enter the pump assembly 112.

Also shown in FIG. 2 is a shroud assembly 126, which includes a shroud 128, a sealing ring 130 and a retaining ring 132. The shroud 128 is preferably constructed of sheet metal or other durable material, such as ceramics or plastics, that can withstand the corrosive environment of the wellbore 104. The shroud 128 includes a closed connection end 133 and an open intake end 134 (shown in FIG. 1). The open intake end 134 permits well fluid to flow into the shroud 128, along the motor 108, into the pump intake 118 and along flow lines 135. In the presently preferred embodiment, the opening 134 is located below the motor assembly 112. However, the shroud can partially enclose the motor assembly 112 for purposes of the present invention. Well fluid that flows along the motor 108 cools the motor 108 in a heat exchange that increases with an increasing flow of the well fluid.

The sealing ring 130 is preferably constructed of a corrosion resistant elastomer or other material suitable for the downhole environment. In a particularly preferred embodiment, the sealing ring 130 is constructed from a fluoroelastomer. An acceptable fluoroelastomer is available from Asahi Glass Co., Ltd. of Tokyo, Japan under the AFLAS® tradename. The sealing ring 130 prevents the flow of well fluid into the shroud 128 at the pump assembly 112 by sealing gaps between the shroud 128 and the pump assembly 112. The retaining ring 132 is preferably attached to the pump connector plate 120 to hold the sealing ring 130 in place. In an alternate preferred embodiment, the retaining ring 132 is attached to the pump intake 118. This alternate preferred embodiment is advantageous for various configurations of pump assemblies 112 wherein the pump intake 118 is attached to the pump assembly 112 using other methods of attachment such as a threaded connection known in the art.

Figure 3:
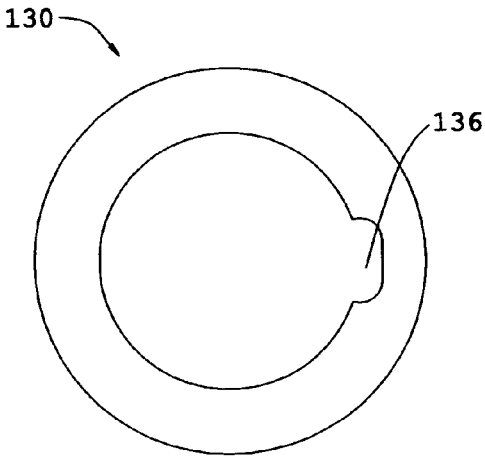
FIG. 3 is a top or bottom view of a sealing ring for use with the pump assembly of FIG. 2.

Turning now to FIG. 3, with reference to FIG. 2, shown therein is a top view of the sealing ring 130 with a seal aperture 136. Power cable 116 (FIG. 2) preferable fits into seal aperture 136 and extends to the motor assembly 108 to provide power. Tape, adhesive or other substance can be used to prevent the flow of well fluid around the power cable 116 and through the seal aperture 136.

Figure 4:
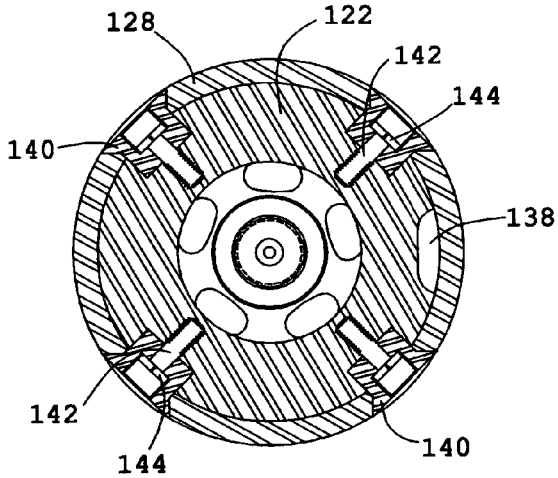
FIG. 4 is a cross sectional view of the pump assembly of FIG. 2.

Referring to FIG. 4, shown therein is a cross sectional view of the pump assembly 112 and shroud 128 of FIG. 2. The shroud 128 is shown adjacent the intake housing 122 and attached thereto. Housing aperture 138 in the intake housing 122 provides a path for the power cable 116 similar to the seal aperture 136 in the sealing ring 130. In a preferred embodiment, a locking key 140 is inserted into the shroud 128 and the intake housing 122, and held in place using a threaded bolt 142 and lock washer 144. The threaded bolt 142 screws into the intake housing 122 to attach the shroud 128 to the intake housing 122.

Although the present invention is shown to be used with a pumping system 100 oriented with the shroud 128 having the opening 134 near the bottom of the pumping system 100, it is envisioned that the shroud assembly 126 can also be used with the opening 134 near the top of the pumping system 100. For example, when pumping wellbore fluids from an upper zone to a lower zone, the pump assembly 112 can be situated below the motor assembly 108. In this configuration, the opening 134 of the shroud 128 is preferably located near the top of the pumping system 100.

In accordance with one aspect of a preferred embodiment, the present invention provides an apparatus for preventing the flow of wellbore fluids through the connection end 133 of the shroud 128, thereby increasing the flow and cooling capacity of the wellbore fluids around the motor. It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A submersible pumping system for pumping wellbore fluid, comprising:

a motor assembly;

a pump assembly connected to the motor assembly; and a shroud assembly attached to the pump assembly, the shroud assembly, comprising:

a shroud having a connection end and an intake end, wherein the shroud at least partially encloses the motor assembly;

a sealing ring that prevents the wellbore fluid from entering the shroud at the connection end, wherein the sealing ring comprises a sealing aperture whereby a cable can extend through the sealing aperture to the motor assembly; and a retaining ring that holds the sealing ring in place.

2. The submersible pumping system of claim 1, wherein the sealing ring is formed of an elastomer material.

3. A shroud assembly for use with a pump assembly and a motor assembly for use in pumping wellbore fluid, the shroud assembly comprising:

a shroud having a connection end and an intake end, wherein the shroud at least partially encloses the motor assembly;

a sealing ring that prevents the wellbore fluid from entering the shroud at the connection end, wherein the sealing ring comprises a sealing aperture whereby a cable can extend through the sealing aperture to the motor assembly; and a retaining ring that holds the sealing ring in place.

4. The shroud assembly of claim 3, wherein the sealing ring is formed of an elastomer material.

5. A downhole pumping system comprising:

a pump intake;

a shroud having a connection end and an intake end, wherein the connection end of the shroud is connected to the outer wall of the pump intake;

a pump connector plate connected to the top of the pump intake a sealing ring disposed between the pump intake, the shroud and the pump connector plate; and a retaining ring secured to the pump connector plate that captures the sealing ring in its position between the pump intake, the shroud and the pump connector plate.

* * * * *